US005325733A

United States Patent [19]

Papasideris et al.

[11] Patent Number: 5,325,733

[45] Date of Patent: Jul. 5, 1994

[54] WORK VEHICLE IMPLEMENT LEVER LOCK

[75] Inventors: Stamos I. Papasideris, Bristol; Thomas F. Stiegart, Somonauk, both of Ill.

[73] Assignee: Caterpillar Inc., Peoria, Ill.

[21] Appl. No.: 16,226

[22] Filed: Feb. 11, 1993

[51] Int. Cl.[5] ..... G05G 5/08; G05G 5/18

[52] U.S. Cl. ..... 74/483 R; 70/199; 74/526

[58] Field of Search ..... 74/483 R, 526; 70/198, 70/199, 200; 137/637.1; 251/111, 113

[56] References Cited

U.S. PATENT DOCUMENTS

| | | | |
|---|---|---|---|
| 589,811 | 9/1897 | Brown | 292/117 |
| 606,484 | 6/1898 | Greife | 292/196 X |
| 1,234,236 | 11/1918 | Carll | 191/93 |
| 1,564,593 | 12/1925 | Lawrence | 292/96 |
| 1,585,144 | 5/1926 | Hannebohn | 292/98 |
| 1,828,927 | 10/1931 | Devereaux | 292/195 |
| 1,865,581 | 7/1932 | Miller | 292/DIG. 23 X |
| 1,985,653 | 12/1934 | Christie et al. | 74/483 R X |
| 2,094,746 | 10/1937 | Palmer et al. | 70/147 |
| 2,131,506 | 9/1938 | Gasstrom | 292/242 |
| 2,140,570 | 12/1938 | Young | 292/25 |
| 2,804,331 | 8/1957 | Courtot | 292/221 |
| 2,899,167 | 8/1959 | Elsner | 248/361 |
| 3,858,695 | 1/1975 | Whisler | 74/483 R X |
| 4,036,077 | 7/1977 | Akiyama | 74/526 |

FOREIGN PATENT DOCUMENTS

| | | | |
|---|---|---|---|
| 511226 | 12/1920 | France | 70/200 |

*Primary Examiner*—Allan D. Herrmann
*Attorney, Agent, or Firm*—Frank L. Hart

[57] ABSTRACT

A work machine control assembly has a plurality of actuating levers each associated with a respective actuating element for controlling respective movements of a work implement of the work machine, for example an excavator. The control assembly of this invention has a cam operated moveable gate which captures portions of the actuating elements and controllably locks them in a preselected position in response to actuation of a lock actuation lever.

6 Claims, 4 Drawing Sheets

WORK VEHICLE IMPLEMENT LEVER LOCK

TECHNICAL FIELD

This invention relates generally to a locking mechanism for implement controlling components of a work machine.

BACKGROUND ART

Various heavy duty work machine have a plurality of implement controlling components for manipulating an implement of the work machine. An example of such a machine would be a wheel loader which has a plurality of levers for manipulating the earth moving bucket through a multiplicity of positions. A common problem in the manufacture of such massive machine is to easily control a plurality of bucket movements by as few operator actions as possible. Placement and position of control levers, one relative to others, also becomes a problem since it is most common during various bucket maneuvers to simultaneously or generally simultaneously operate several controlling levers. Overall efficiency of vehicle operations often depends on the operator's skill in adjusting and manipulating the correct levers in the correct sequence at the optimum times.

In one operation of wheel loaders, for example, it is desirable to lock a plurality of controlling components at a preselected position for a desirable time during manipulation of other controlling components. For example, locking of the lift and tilt kickout controlling components. To increase efficiency of operation, it is desirable for the operator to initiate locking or releasing of these components in response to as few operator movements as possible.

The present invention is directed to overcoming one or more of the problems as set forth above.

DISCLOSURE OF THE INVENTION

In one aspect of the present invention a work machine has a control assembly which has a plurality of implement actuation levers. Each actuation lever is associated with a respective actuating element for controlling respective movements of an implement of the work vehicle in response to pivotal movement of the actuating elements responsive to movement of the respective actuation lever. The actuating elements each have a longitudinal axis, a first end portion connected to and pivotally connected to a frame and a latchable element extending generally along the actuating element axis and outwardly therefrom. A gate of the invention has a cam surface and a plurality of spaced apart slots. Each slot has an axis extending in a first direction and a latch opening communicating with the slot and extending a second direction transverse the slot. Each slot is of a size sufficient to receive a respective latchable element for movement along the slot in response to movement of said respective lever. The gate is moveable in the second direction between a first position at which the latchable elements are positioned within a respective slot and free to move along said slot and a second position at which the latchable elements are within respective latch openings and maintaining said latchable element and associated actuating element against pivotal movement.

The gate is biased in the second direction and a cam follower is contactable with the cam surface of the gate and is moveable along the cam surface for moving the gate between the first and second positions. A first rotatable shaft has a longitudinal axis and is connected to the cam follower and is rotatable for controllably moving the cam follower along the cam surface of the gate. A second rotatable shaft has a longitudinal axis and extends generally parallel to said first rotatable shaft.

A first link is connected to the first rotatable shaft, extends transverse the first rotatable shaft axis and is moveable therewith. A second link is connected to the second rotatable shaft, extends transverse the second rotatable shaft axis and is moveable therewith. A connecting link has first and second end portions. The first end portion is pivotally connected to said first link and the second end portion is pivotally connected to the second link. A lock actuation lever is connected to the second rotatable shaft for controllably rotating the second rotatable shaft and responsively moving the gate and locking and releasing the associated actuating elements.

BEST MODE FOR CARRYING OUT THE INVENTION

Figure 1:
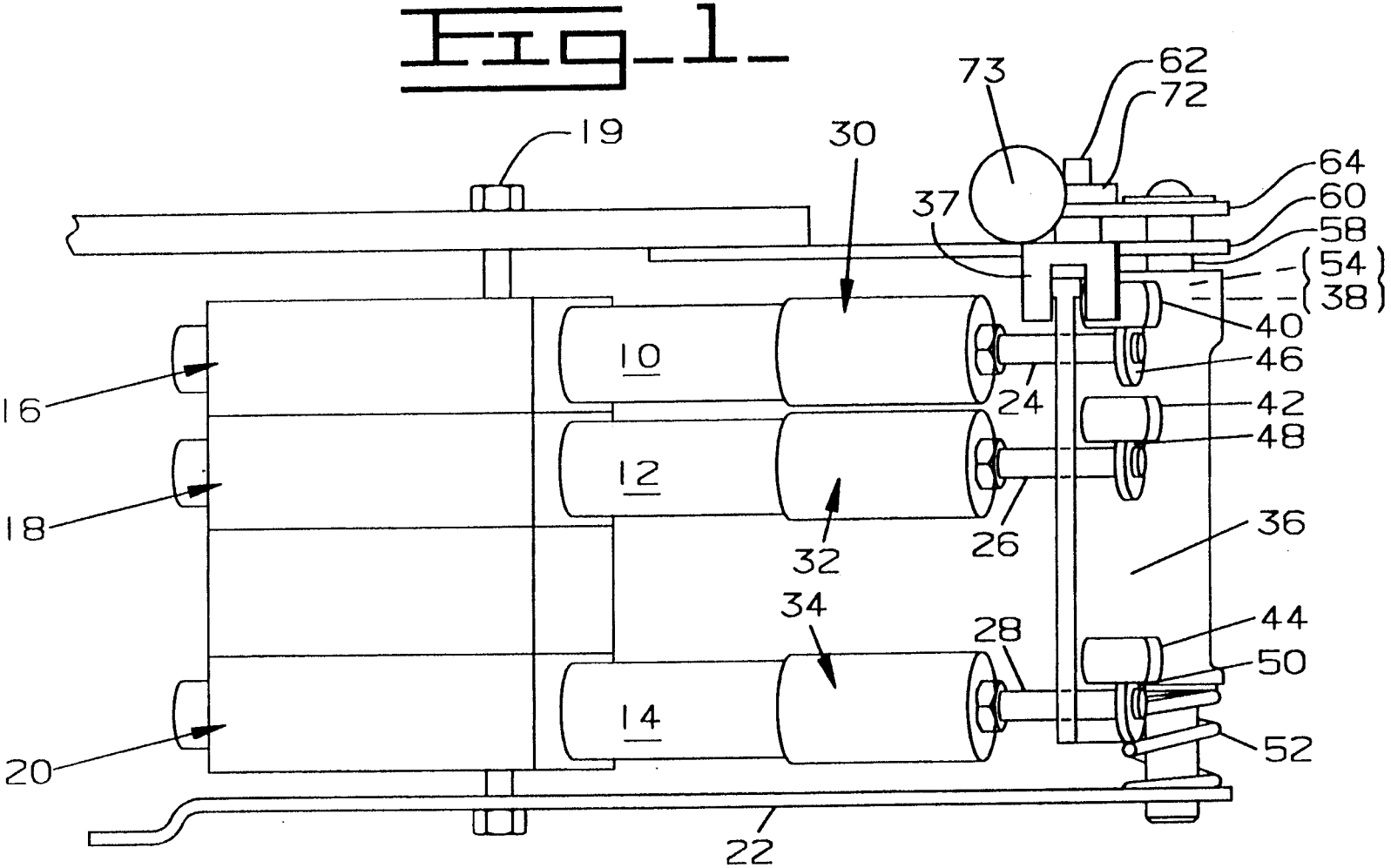
FIG. 1 is a diagrammatic top view of a control system having the apparatus of this invention.
Figure 2:
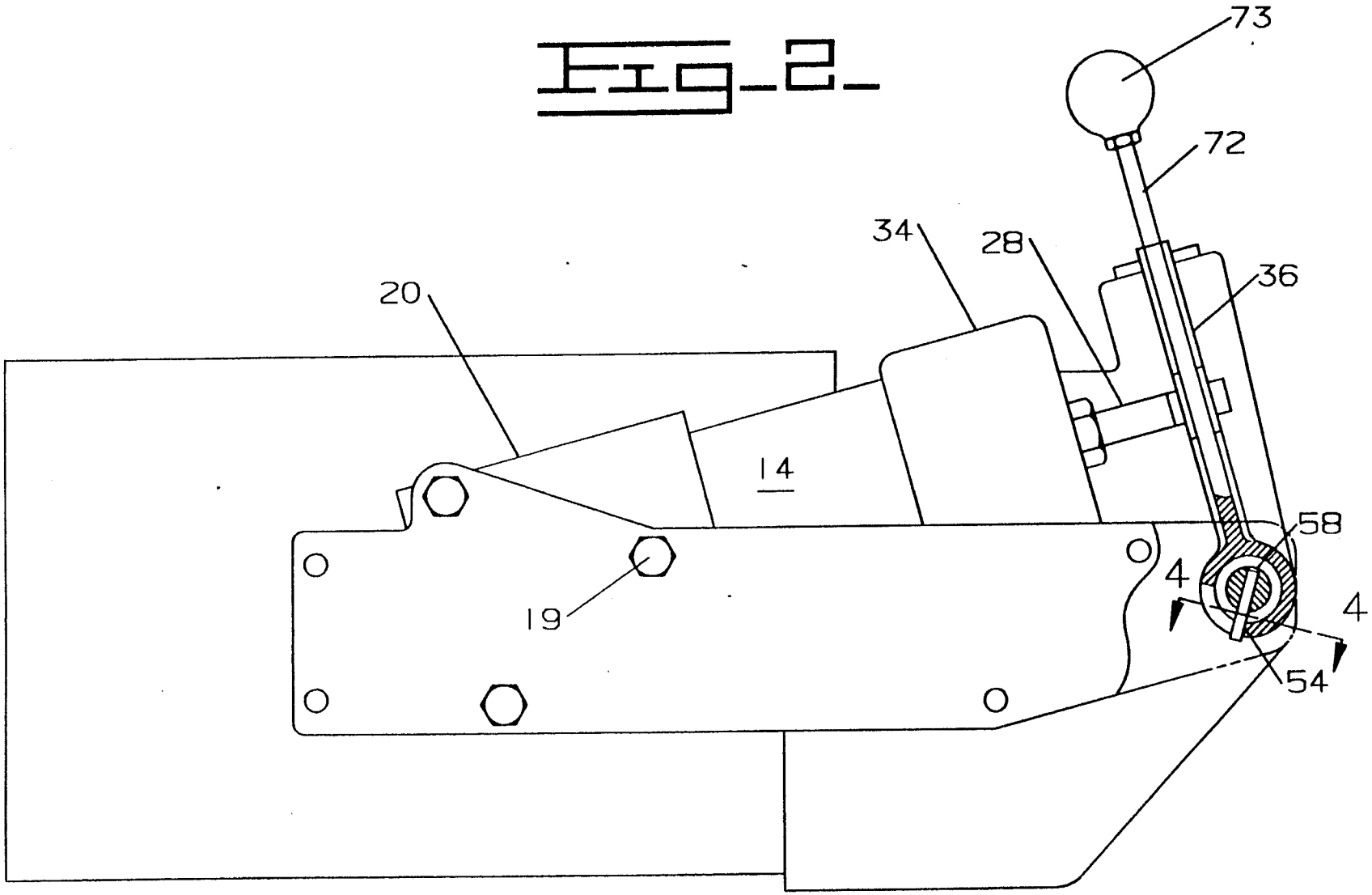
FIG. 2 is a side view of the apparatus of FIG. 1.
Figure 3:
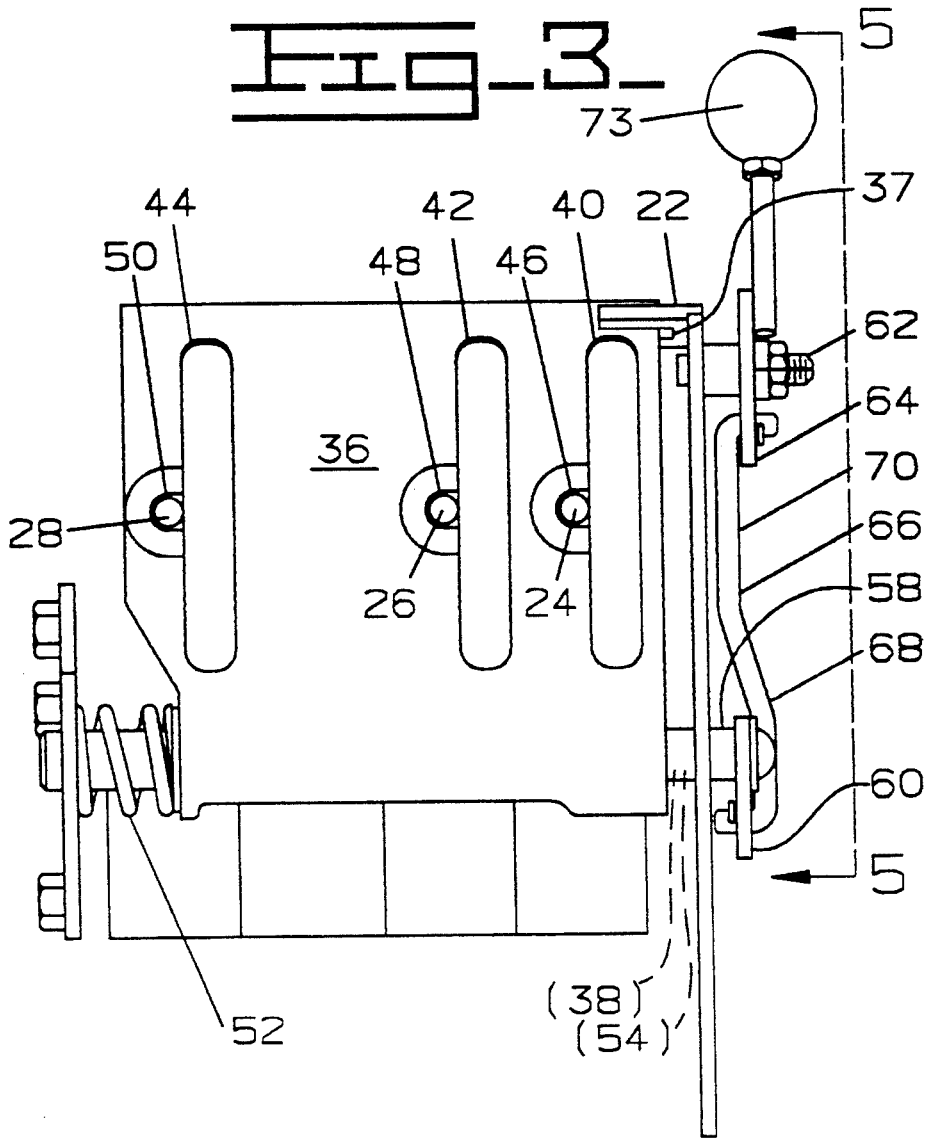
FIG. 3 is a frontal view of the apparatus of FIG. 1.

Referring to FIGS. 1, 2, and 3, a work vehicle (not shown), for example an excavator or a backhoe, has a bucket whose movement is controlled by a plurality of implement actuation levers each of which are associated with a respective actuating element 10,12,14. The actuating elements each have a longitudinal axis, a first end portion 16,18,20 pivotally connected via bolt 19 to a frame 22 and a latchable element 24,26,28 extending generally along the actuating element axis and outwardly from a second end portion 30, 32,34 of the respective actuating element 10,12,14. The actuating elements 10,12,14 can be, for example, hydraulic pilot cylinders or solenoid valves. Such an arrangement is well known in the art of excavators, backhoes and other work vehicles.

The locking system of this invention has a gate 36 which has a cam surface 38 (better seen in FIG. 4) and a plurality of spaced apart slots 40,42,44. Each slot 40,42,44 has an axis extending in a first direction with a respective latch opening 46,48,50 communicating with its slot and extending in a second direction transverse the slot axis. Each slot 40,42,44 is of a size sufficient to receive a respective latchable element 24,26,28 for movement along the respective slot 40,42,44 in response to movement of said respective lever. The gate 36 is moveable within "U" shaped frame element 37 in the second direction between a first position at which the latchable elements 24,26,28 are positioned with a respective slot 40,42,44 and free to move along said slot 40,42,44 and a second position, as shown in FIG. 3, at which the latchable 24,26,28 elements are within respective latch openings 46,48,50 and maintaining said latchable elements 24,26,28 and associated actuating elements 10,12,14 against pivotal movement.

Means such as one or more helical springs 52 are associated with the gate 36 for biasing the gate 36 in the second direction. As can be seen, the second direction is transverse the direction of the slots 40,42,44 and the actual direction of biasing will be dependent upon which side of the gate 36 the spring(s) 52 are located. Preferably the spring(s) 52 will bias the gate toward its locked position.

Figure 4:
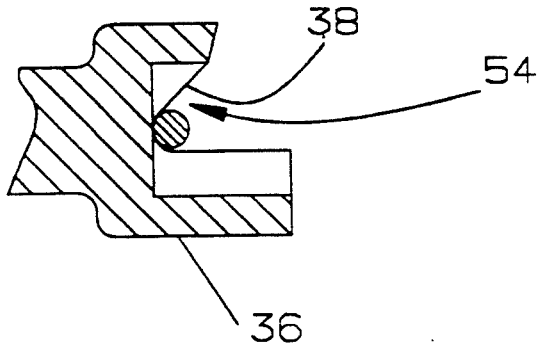
FIG. 4 is a sectional view taken along lines 4—4 in FIG. 2.

A cam follower 54 is contactable with the cam surface 38, as shown in FIGS. 2 and 4, and is moveable along the cam surface for moving the gate 36 between the first and second positions.

Figure 5:
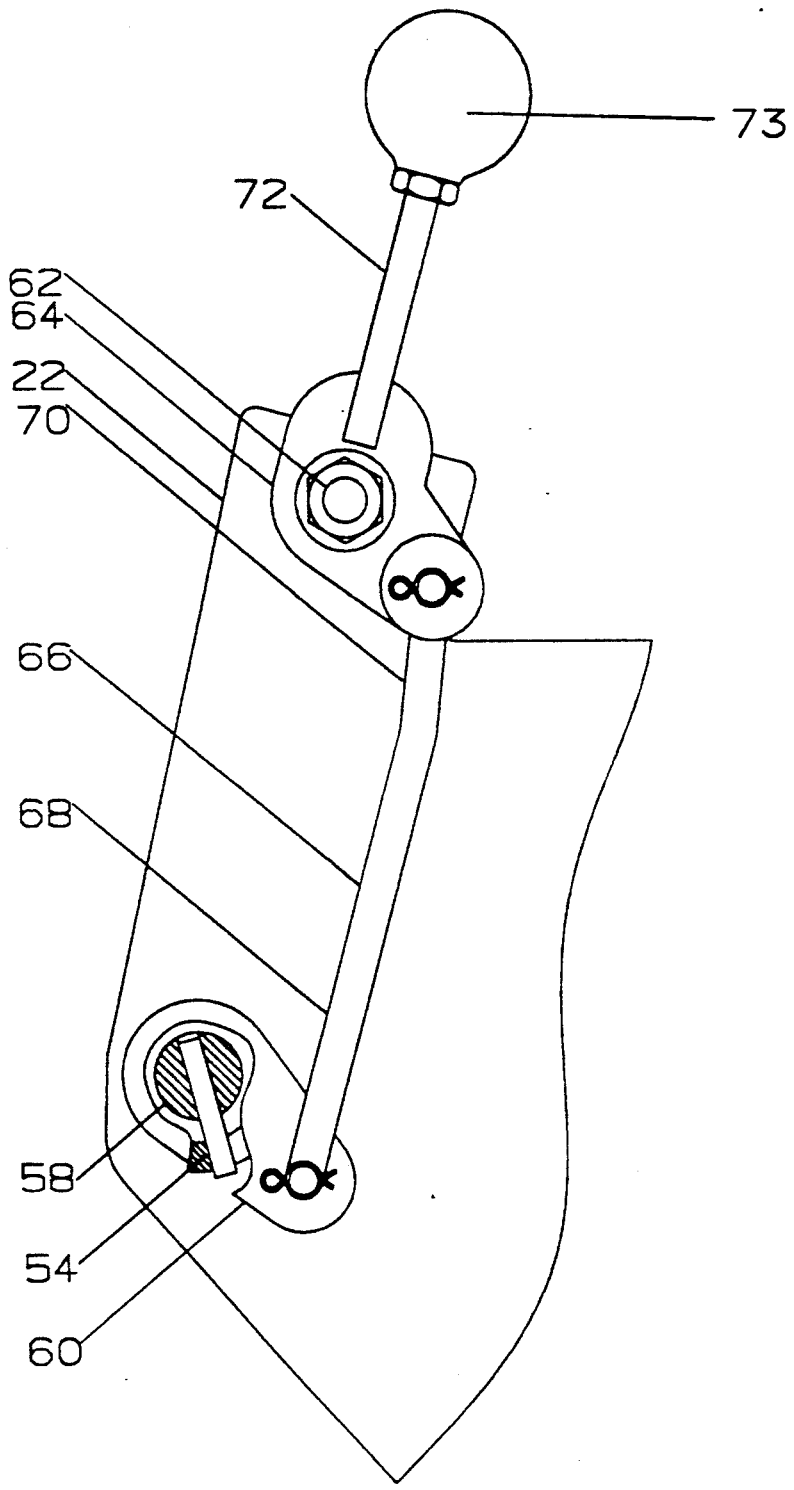
FIG. 5 is an enlarged side view taken along lines 5—5 of FIG. 3.

Referring to FIGS. 1 and 5, a first rotatable shaft 58 has a longitudinal axis and is connected to the cam follower 54 and is rotatable for controllably moving the cam follower 54 along the cam surface of the gate 36. A first link 60 is connected to the first rotatable shaft 58, extends transverse the longitudinal axis for the first rotatable shaft 58 and is moveable therewith.

A second rotatable shaft 62 has a longitudinal axis extending generally parallel to said first rotatable shaft 58. Both of the shafts 58,62 are rotatably connected to the frame 22. A second link 64 is connected to the second rotatable shaft 62, extends transverse the second rotatable shaft axis and is moveable therewith.

A connecting link 66 has first and second end portions 68,70. The first end portion 68 is pivotally connected to the first link 60 and the second end portion 70 is pivotally connected to the second link 64.

Referring to FIGS. 2 and 5, a lock actuation lever 72 having a knob 73 is connected to the second rotatable shaft 62 for controllably rotating the second rotatable shaft 62 and responsively moving the gate 36 and locking and releasing the associated actuating elements 10,12,14.

The actuating elements 10,12,14 are pivotally connected to the frame 22 and pivotally 10 moveable about a common axis. The axis of the actuating elements 10,12,14 at the locked position are at an angle in the range of about 0 to about 45 degrees relative to horizontal, more preferably at an angle of about 15 degrees.

The latch openings 46,48,50 are each positioned at generally the mid point between the ends of their gate slot 40,42,44. However, in some cases the latch openings 46,48,50 may desirably be positioned at different preselected elevations relative one the other as measured along the cam surface from one end of the slots 40,42,44

INDUSTRIAL APPLICABILITY

In the operation of the apparatus of this invention, the operator can move lever 72 to lock actuation elements 10,12 and 14 at their position when lever 72 is moved. Movement of lever 72 rotates shaft 62 which in turn rotates the second link 64. As link 64 moves the connecting link 66 causes the first link 60 to move which rotates the first shaft 58.

Rotation of the first shaft 58 causes follower 54 to move along the cam surface 38 which urges the gate to shift in the second direction and cause latch elements 24,26, and 28 to be received into respective latch openings 46,48,50 and be maintained by the gate and prevent pivotal movement of the actuating elements 10,12, and 14.

It should be understood that the number of actuating elements can be different from the three shown in the drawings and that the gate can be constructed with different arrangements of slots or locations of latch openings relative to slot lengths.

Other aspects, objects and advantages of this invention can be obtained from a study of the drawings, the disclosure and the appended claims.

I claim:

1. In a work machine control assembly having a plurality of implement actuation levers each associated with a respective actuating element for controlling respective movements of an implement of the work machine in response to pivotal movement of the actuating elements in response to movement of the respective actuation lever, said actuating elements each having a longitudinal axis, a first end portion pivotally connected to a frame and a latchable element extending generally along the actuating element axis and outwardly from a second end portion of the actuating element, the improvement comprising:

a gate having a cam surface and a plurality of spaced apart slots, each slot having an axis extending in a first direction with a latch opening communicating with said slot and extending in a second direction transverse the slot axis, each slot being of a size sufficient to receive a respective latchable element for movement along the slot in response to movement of said respective lever and said gate being moveable in the second direction between a first position at which the latchable elements are positioned within a respective slot and free to move along said slot and a second position at which the latchable elements are within respective latch openings and maintaining said latchable element and associated actuating elements against pivotal movement;

means for biasing the gate in the second direction;

a cam follower contactable with the cam surface of the gate and being moveable along the cam surface for moving the gate between the first and second positions;

a first rotatable shaft having a longitudinal axis and being connected to the cam follower and being rotatable for controllably moving the cam follower along the cam surface of the gate;

a first link connected to the first rotatable shaft, extending transverse the first rotatable shaft axis and being moveable therewith;

a second rotatable shaft having a longitudinal axis extending generally parallel to said first rotatable shaft;

a second link connected to the second rotatable shaft, extending transverse the second rotatable shaft axis and being moveable therewith;

a connecting link having first and second end portions, said first end portion being pivotally connected to said first link and said second end portion being pivotally connected to said second link; and a lock actuation lever connected to the second rotatable shaft for controllably rotating the second rotatable shaft and responsively moving the gate and locking and releasing the associated actuating elements.

2. A work machine control assembly, as set forth in claim 1, wherein the actuating elements are pivotally connected to the frame and pivotally moveable about a common axis.

3. A work machine control assembly, as set forth in claim 1, wherein the axis of the actuating elements at the locked position are at an angle in the range of about 0 to about 45 degrees relative to horizontal.

4. A work machine control assembly, as set forth in claim 1, wherein the latch openings are each positioned at generally the mid point of their respective gate slot.

5. A work machine control assembly, as set forth in claim 1, wherein the biasing means of the gate is a spring biasing the gate toward the locked position.

6. A work machine control assembly, as set forth in claim 1, wherein the first and second rotatable shaft's axis and a surface of the gate extend generally perpendicularly relative to the actuating element's axis.

* * * * *

UNITED STATES PATENT AND TRADEMARK OFFICE

CERTIFICATE OF CORRECTION

PATENT NO. : 5,325,733

DATED : July 5, 1994

INVENTOR(S) : STAMOS I. PAPASIDERIS ET AL.

It is certified that error appears in the above-identified patent and that said Letters Patent is hereby corrected as shown below:

On the title page, item [54], and column 1, line 2:

The title should be: "WORK MACHINE IMPLEMENT LEVER LOCK"

Signed and Sealed this

Thirteenth Day of December, 1994

*Attest:*

Bruce Lehman

BRUCE LEHMAN

*Attesting Officer*

*Commissioner of Patents and Trademarks*